US009878567B2

(12) United States Patent
Ono et al.

(10) Patent No.: US 9,878,567 B2
(45) Date of Patent: Jan. 30, 2018

(54) THERMAL RECORDING SHEET

(71) Applicant: Osaka Sealing Printing Co., LTD., Osaka (JP)

(72) Inventors: Shinichi Ono, Osaka (JP); Masahiko Yoshida, Osaka (JP); Takayuki Kimura, Osaka (JP)

(73) Assignee: Osaka Sealing Printing Co., LTD., Osaka (JP)

( * ) Notice: Subject to any disclaimer, the term of this patent is extended or adjusted under 35 U.S.C. 154(b) by 0 days.

(21) Appl. No.: 15/035,677

(22) PCT Filed: Nov. 7, 2014

(86) PCT No.: PCT/JP2014/079621
§ 371 (c)(1),
(2) Date: May 10, 2016

(87) PCT Pub. No.: WO2015/072411
PCT Pub. Date: May 21, 2015

(65) Prior Publication Data

US 2016/0263926 A1 Sep. 15, 2016

(30) Foreign Application Priority Data

Nov. 15, 2013 (JP) ..... 2013-236907

(51) Int. Cl.
*B41M 5/42* (2006.01)
*B41M 5/50* (2006.01)
*B41M 5/41* (2006.01)

(52) U.S. Cl.
CPC ..... *B41M 5/502* (2013.01); *B41M 5/42* (2013.01); *B41M 5/41* (2013.01); *B41M 2205/04* (2013.01);
(Continued)

(58) Field of Classification Search
CPC ..... B41M 1/14; B41M 5/30; B41M 5/337; B41M 5/3377; B41M 5/42; B41M 5/426;
(Continued)

(56) References Cited

U.S. PATENT DOCUMENTS 4,857,501 A 8/1989 Usami et al.
5,643,851 A 7/1997 Kagawa
(Continued)

FOREIGN PATENT DOCUMENTS

EP 0273752 7/1988
JP 1156062 A2 6/1989
(Continued)

OTHER PUBLICATIONS

International Search Report dated Dec. 22, 2014 filed in PCT/JP2014/079621.

*Primary Examiner* — Bruce H Hess
(74) *Attorney, Agent, or Firm* — Rankin, Hill & Clark LLP

(57) ABSTRACT

[Problems] Provided is a thermal recording sheet in which both a thermal recording layer having developed color and a printed layer can be clearly recognized from the front surface side of the sheet.
[Solution] A thermal recording sheet having a front surface and a back surface opposite the front surface includes: a substrate layer; a recording layer formed on the front surface side of the substrate layer and containing a color developing material that develops color by heating; a protective layer formed on the further front surface side of the recording layer; and a printed layer formed on the back surface side of the recording layer. In a state before the recording layer develops color, a portion containing the recording layer and the protective layer and formed on the front surface side to the printed layer is transparent.

8 Claims, 3 Drawing Sheets

(52) U.S. Cl.
CPC ..... *B41M 2205/36* (2013.01); *B41M 2205/38* (2013.01); *B41M 2205/40* (2013.01)

(58) Field of Classification Search
CPC ..... B41M 2205/04; B41M 2205/38; B41M 2205/40
USPC ..... 503/200, 226
See application file for complete search history.

(56) References Cited

U.S. PATENT DOCUMENTS

| | | | |
|---|---|---|---|
| 5,677,365 | A | 10/1997 | Katsuyuki |
| 6,921,740 | B1 | 7/2005 | Takahisa |
| 2012/0208698 | A1 | 8/2012 | Akihito |
| 2016/0159035 | A1 | 6/2016 | Yoshida |
| 2016/0263926 | A1 | 9/2016 | Yoshida |

FOREIGN PATENT DOCUMENTS

| | | | |
|---|---|---|---|
| JP | 04325287 | | 11/1992 |
| JP | 6048034 | A2 | 2/1994 |
| JP | 06227124 | | 8/1994 |
| JP | 7266764 | A2 | 10/1995 |
| JP | 7276815 | A2 | 10/1995 |
| JP | 08025807 | | 1/1996 |
| JP | 8156406 | A2 | 6/1996 |
| JP | 8230333 | A2 | 9/1996 |
| JP | 10006652 | A2 | 1/1998 |
| JP | 10251591 | A2 | 9/1998 |
| JP | 11099749 | | 4/1999 |
| JP | 11099749 | A2 | 4/1999 |
| JP | 11165464 | A2 | 6/1999 |
| JP | 11327445 | A2 | 11/1999 |
| JP | 2001341427 | A2 | 12/2001 |
| JP | 2001353964 | A2 | 12/2001 |
| JP | 2002127614 | A2 | 5/2002 |
| JP | 2002362027 | A2 | 12/2002 |
| JP | 200540989 | | 2/2005 |
| JP | 2005088223 | A2 | 4/2005 |
| JP | 2006212975 | A2 | 8/2006 |
| JP | 2008073858 | A2 | 4/2008 |
| JP | 2008168566 | A2 | 7/2008 |
| JP | 2008188832 | A2 | 8/2008 |
| JP | 201023252 | | 2/2010 |
| JP | 2010089497 | A2 | 4/2010 |
| WO | 2011027752 | A1 | 3/2011 |
| WO | 2015012386 | A1 | 1/2015 |
| WO | 2015072410 | A1 | 5/2015 |
| WO | 2015072411 | A1 | 5/2015 |

THERMAL RECORDING SHEET

TECHNICAL FIELD

The present invention relates to a thermal recording sheet including a printed layer.

BACKGROUND ART

There is used a thermal recording sheet in which information can be recorded by color development through a chemical reaction initiated by heating with a thermal head or the like. This thermal recording sheet is used as a recording medium in a facsimile, an automatic ticket vending machine, a scientific measuring instrument, or the like. Furthermore, the thermal recording sheet is also used as a recording medium for a POS system in a retail store. In this manner, this thermal recording sheet is used in a wide range of applications.

This thermal recording sheet often includes a printed layer formed by previously performing printing, other than a thermal recording layer that develops color by heating. For example, Patent Literature 1 discloses disposing a printed layer on the back surface side of a paper sheet that is a support body of the thermal recording body.

Hereinafter, as described herein, printing performed by allowing the thermal recording layer to develop color is referred to as "typing", and printing having been previously performed is simply referred to as "printing."

When a printed layer is formed on the back surface side of a paper sheet that is an opaque support body, like the technology disclosed in Patent Literature 1, the printed contents can be recognized only from the back surface side. Furthermore, the typed contents can be recognized only from the front surface. However, there are many cases in which both need to be recognized from the front surface side.

On the other hand, Patent Literature 2 discloses a technology of forming a printed layer on the front surface side of a thermal recording layer of a thermal recording body. The use of such a technology enables both the printed and typed contents to be recognized from the front surface side.

However, when a printed layer is formed on a thermal recording layer by printing, the thermal recording layer is concealed by the printed layer. Therefore, even if typing is performed, the typed contents cannot be recognized from the front view side. To address this concern, for achieving a structure in which both the printed and typed contents can be recognized from the front surface side, a thermal recording body needs to be configured such that a printed layer is not formed on the area where typing is required. The area where printing has been performed and the area where typing has not been performed, that is, the printed layer and the typing area, come to be formed in separate areas.

However, such separate areas cause a different thickness by as much as the typed layer. This leads to generation of a step between the printing area and the typing area. Accordingly, for example, when typing with a thermal head is performed, this difference in thickness causes optimum head adjustment to become difficult. Specifically, it becomes difficult to accurately adjust the distance between the head and the surface of a thermal recording sheet, and to adjust an optimum amount of heat. Furthermore, the step causes smoothness to decrease. Therefore, typing failures such as typing shrinkage and stick are likely to be caused.

Furthermore, when a printed layer is formed on the front surface, the printed layer is susceptible to scratches. In addition, a certain component contained in the printed layer may cause a thermal head to be contaminated by the printed layer or to fail.

Especially, when a printed layer is formed with metal-containing ink or the like, the surface of the printed layer is energized when it comes into contact with a thermal head. Then, the thermal head may fail by spark causing disconnection of the thermal head or by metal in the printed layer excessively absorbing heat energy. Furthermore, friction with the metal in the printed layer may cause the surface of the thermal head to wear. In addition, metal adhered to the thermal head may cause the surface of the thermal recording sheet to be scratched. Therefore, it is difficult to perform printing having excellent design features and metal gloss with the metal-containing ink.

CITATION LIST

Patent Literature

Patent literature 1: JP-A-2006-212975
Patent literature 2: JP-A-2005-88223

SUMMARY OF THE INVENTION

Problems to be Solved by the Invention

The present invention has been achieved for solving the above-described problems. According to the present invention, both the typed and printed contents can be recognized from the front surface side. Furthermore, there is provided a thermal recording sheet that presents no particular problem even in typing with a thermal head.

Solution to the Problems (1) An aspect of the present invention relates to a thermal recording sheet having a front surface and a back surface opposite the front surface, the thermal recording sheet including: a substrate layer; a recording layer formed on the front surface side of the substrate layer and containing a color developing material that develops color by heating; a protective layer formed on the further front surface side of the recording layer; and a printed layer formed on the back surface side of the recording layer, wherein in a state before the recording layer develops color, a portion containing the recording layer and the protective layer and formed on the front surface side to the printed layer is transparent.

In such a thermal recording sheet, the recording layer is formed on the front surface side to the printed layer. Therefore, the typed contents formed in the recording layer by color development can be recognized from the front surface side. Also, the printed layer is located on the back surface side to at least the recording layer. Therefore, a thermal head is not brought into direct contact with the printed layer during typing. Therefore, typing with a thermal head does not raise particular problems. Furthermore, a portion formed on the front surface side to the printed layer is transparent. Therefore, even when the printed layer is formed on the back surface side of the recording layer, printed contents can be recognized from the front surface side of the sheet.

(2) According to a preferred embodiment, the substrate layer is formed with a transparent material. A portion formed on the front surface side to the printed layer further contains the substrate layer. According to such a configuration, a portion formed on the front surface side to the printed layer contains the substrate layer. This portion is transparent in the state before the recording layer develops color. Therefore, the printed layer can be clearly recognized from the front surface side of the sheet.

(3) The printed layer preferably contains metal. The inclusion of metal in the printed layer enables glossy printing. Therefore, printing with excellent design features can be performed. Here, the printed layer is formed on the back surface side of the recording layer. Therefore, the printed layer is not brought into direct contact with a thermal head. Thus, even when the printed layer contains metal, particular problems are not raised in typing with a thermal head.

(4) The portion formed on the front surface side to the printed layer preferably has an opacity of 25% or less in accordance with JIS P8138 in the state before the recording layer develops color. In such a thermal recording sheet, the portion formed on the front surface side to the printed layer has high transparency. Therefore, the printed layer can be clearly recognized.

(5) The recording layer contains a first irregular reflection suppression component for suppressing irregular reflection in the portion formed on the front surface side to the printed layer. The first irregular reflection suppression component preferably contains an organic material having a melting point lower than the color developing temperature of the color developing material. Such a first irregular reflection suppression component melts at least when the recording layer develops color. Then, the first irregular reflection suppression component intrudes into spaces between particles contained in the recording layer and into spaces formed at the interface between layers constituting the thermal recording sheet. This can suppress irregular reflection and improve transparency.

(6) The organic material preferably contains paraffin. Such an organic material has an appropriate melting point. Therefore, the organic material easily melts at least when the recording layer develops color. Therefore, irregular reflection can be suppressed more easily.

(7) The thermal recording sheet further includes an intermediate layer on the front surface side of the recording layer and on the back surface side of the protective layer, and the intermediate layer is at least partially in contact with the recording layer. The intermediate layer contains a second irregular reflection suppression component for suppressing irregular reflection in a portion formed on the front surface side to the printed layer. The second irregular reflection suppression component preferably contains hydrophilic resin or water-soluble resin. The disposition of such an intermediate layer can further improve transparency in the portion formed on the front surface side to the printed layer of the thermal recording sheet. Moreover, barrier properties can easily improve.

(8) The second irregular reflection suppression component is preferably a core shell-type particle containing the hydrophilic resin or the water-soluble resin in a shell. When such a core shell-type particle is used, hydrophilic resin or water-soluble resin contained in a shell is allowed to intrude into the recording layer. Therefore, there can be enhanced the effect of suppressing irregular reflection in the portion formed on the front surface side to the printed layer.

(9) The protective layer preferably contains a binder and a filler. The filler preferably contains colloidal silica. Such a protective layer has appropriate strength. Furthermore, the protective layer can more effectively suppress irregular reflection in the portion formed on the front surface side to the printed layer.

Effects of the Invention

According to the thermal recording sheet of the present invention, both the thermal recording layer having developed color (specifically, information formed in the thermal recording layer by color development with heat) and the printed layer can be clearly recognized from the front surface side of the sheet.

DESCRIPTION OF THE EMBODIMENTS

Hereinafter, embodiments of the present invention will be described with reference to the drawings.

First Embodiment

Figure 1:
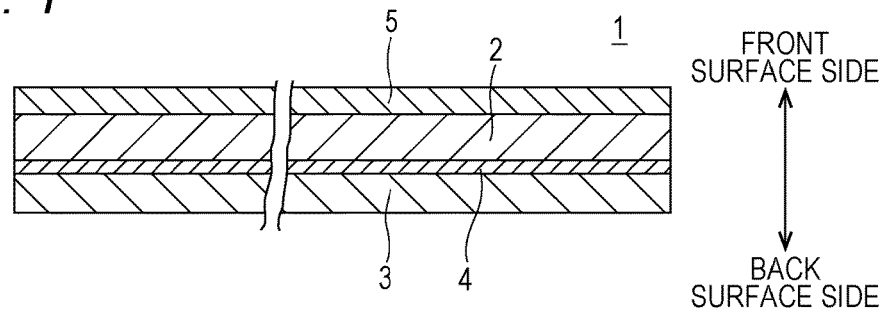
FIG. 1 is a schematic cross-sectional view of a thermal recording sheet according to a first embodiment.

FIG. 1 is a schematic cross-sectional view of a thermal recording sheet according to a first embodiment to which the present invention is applied. The directions of the front surface side and the back surface side of a thermal recording sheet 1 are indicated by arrows in the drawing. The thermal recording sheet 1 has a front surface and a back surface opposite the front surface, and includes a recording layer 2, a substrate layer 3, a printed layer 4, and a protective layer 5.

Specifically, the recording layer 2 is formed on the front surface side of the substrate layer 3. The protective layer 5 is formed on the further front surface side of the recording layer 2. The printed layer 4 is formed on the back surface side of the recording layer 2, that is, between the substrate layer 3 and the recording layer 2. A portion formed on the front surface side to the printed layer 4, that is, the recording layer 2 and the protective layer 5, is transparent. Here, the portion formed on the front surface side to the printed layer 4 being transparent means that in a state before the recording layer 2 develops color, the thermal recording sheet 1 is in a state in which the printed layer 4 can be visually recognized through the portion formed on the front surface side to the printed layer 4. Specifically, in the state before the recording layer develops color, the opacity in accordance with JIS P8138, which is a measurement standard for the opacity of paper, is preferably 25% or less, and further preferably 20% or less. The opacity can be measured using, for example, a commercially available reflectometer. It is noted that the printed layer 4 is formed on the whole surface on the back surface side of the recording layer 2.

The thermal recording sheet 1 includes the recording layer 2. Therefore, typing can be performed by a simple method such as thermal typing with a thermal head. Furthermore, in this thermal recording sheet 1, the printed layer 4 is formed on the back surface side of the sheet, not on the front surface of the sheet, and is specifically formed on the back surface side to the recording layer 2. Therefore, color developing properties of the recording layer 2 is not damaged by the influence of the printed layer 4. Information formed in the recording layer 2 by color development can be clearly recognized. The portion formed on the front surface side to the printed layer 4 is transparent in the state before the recording layer 2 develops color. Therefore, the printed layer 4 can be clearly recognized from the front surface side of the sheet. Hereinafter, each layer constituting the thermal recording sheet 1 will be described in detail.

(Substrate Layer 3)

As the substrate layer 3, any known substrate used in a thermal recording sheet can be used. Examples of the substrate layer 3 may include a resin film, metal foil, paper, nonwoven fabric, and woven fabric.

Examples of the resin film may include polyolefin resin such as polyethylene and polypropylene, styrene resin such as polystyrene, polyester resin such as polyethylene terephthalate, and carbonate-based resin such as polycarbonate. One of these resins may be used alone. Alternatively, two or more of these resins may be used in combination.

The resin film may be an unstretched film, or may be a stretched film. The stretched film may be either a uniaxially stretched film or a biaxially stretched film. The substrate layer 3 may be either a single-layer film or a multi-layer film.

From the viewpoint of handling properties, easiness of forming another layer, transparency, and the like, the substrate layer 3 has a thickness of, for example, 5 to 150 μm, preferably 10 to 100 μm, and further preferably 20 to 70 μm.

(Printed Layer 4)

The printed layer 4 is formed on the front surface side of the substrate layer 3. The recording layer 2 is formed on the further front surface side of the printed layer 4. Therefore, it can be said that the printed layer 4 is formed on the back surface side of the recording layer 2.

In this manner, the printed layer 4 is formed on the back surface side of the recording layer 2. Therefore, typed contents are not concealed by the printed layer 4 when viewed from the front surface side. Even when the printed layer 4 is formed in an entire area, typed contents can be recognized from the front surface side. Furthermore, the portion formed on the front surface side to the printed layer 4 is transparent. That is, the printed layer 4 is visually recognized from the front surface side through the portion formed on the front surface side to the printed layer 4. Therefore, the recording layer 2 does not conceal printed contents except for the portion in which color is developed for typing.

Furthermore, the printed layer 4 is located on the back surface side of the recording layer 2. Therefore, the printed layer 4 is not brought into direct contact with a thermal head or the like. Thus, the printed layer 4 does not have an adverse effect on a thermal head. As a result, ink for forming the printed layer 4 does not need to be limited. That is, the printed layer 4 may be formed by any method of gravure printing, offset printing, rotary letterpress printing, UV printing, silk screen printing, and the like. The printing method may be timely selected according to the application and the compatibility with a substrate material. The dye and pigment to be used are also not particularly limited. Examples thereof may include a pigment ink, a dye ink, and a printing ink. The printing ink may contain a pigment, a vehicle (such as varnish), an additive, and the like. The printing ink to be used may be light transmissive, light absorptive, or light reflective depending on its application.

Furthermore, metal which had a particularly large adverse effect on a thermal head may also be contained in the printed layer 4. Such a printed layer 4 may be formed by printing with a metal-containing ink by the above-described method. The printed layer 4 may also be formed by depositing metal on the substrate or the like. The type of metal is not particularly limited. Examples of the metal may include any known metal such as aluminum, aluminum alloy, copper, copper alloy (such as copper-nickel ally and copper-zinc alloy), silver, and silver alloy. The form of the metal to be contained may be any form such as metal powder, metal flakes, and metal fiber. The printed layer 4 containing these metals is excellent in design features and light shielding properties.

(Recording Layer 2)

The recording layer 2 contains a color developing material that develops color by heating. The color developing material is not particularly limited as long as it can develop color by heating. A dye that can develop color on its own may be used. A combination of a transparent or pale color dye (leuco dye) and a developer that enables this dye to develop color by heating may be used. The color developing material containing a combination of a leuco dye and a developer is also used in a common thermal recording paper sheet or the like, and is therefore readily available and has high versatility.

As the leuco dye, any known dye can be used. Examples thereof may include various leuco dyes based on triphenyl methane phthalide, triallyl methane, fluoran, phenothiazine, thiofluoran, xanthene, indophthalyl, spiropyran, azaphthalide, chromenopyrazole, methine, rhodamine anilino lactam, rhodamine lactam, quinazoline, diazaxanthene, bislactone, and the like. One type of the leuco dyes may be used alone. However, the use of a combination of two or more types enables typing with a desired color to be performed.

Of the above-described leuco dyes, a fluoran-based leuco dye and a phthalide-based leuco dye are preferred. Examples of the fluoran-based leuco dye may include 3-alkyl-2-anilino-6-(N,N-dialkylamino)fluoran such as 2-anilino-6-diethylamino-3-methylfluoran, 2-anilino-6-(N-n-propyl-N-methylamino)-3-methylfluoran, 2-anilino-6-(N-sec-butyl-N-ethylamino)-3-methylfluoran, 2-anilino-6-di(n-butyl)amino-3-methylfluoran, and 6-(N-isopentyl-N-ethyl)amino-3-methyl-2-o-chloroanilino fluoran, 3-alkyl-2-anilino-6-(N-alkoxyalkyl-N-alkylamino)fluoran such as 2-anilino-6-(N-ethoxypropyl-N-ethyl)amino-3-methylfluoran, 3-alkyl-2-anilino-6-(N-alkyl-N-cycloalkylamino)fluoran such as 2-anilino-3-methyl-6-(N-cyclohexyl-N-methylamino)fluoran, 3-alkyl-2-anilino-6-(N-alkyl-N-arylamino)fluoran such as 2-anilino-3-methyl-6-(N-methyl-N-p-toluidino)fluoran and 2-anilino-3-methyl-6-(N-ethyl-N-p-toluidino)fluoran, 2-anilino-3-alkylfluoran compounds having a cyclic amino group at 6-position such as 2-anilino-3-methyl-6-pyrrolidinofluoran, 2-halogenated anilino-6-dialkylaminofluoran such as 2-(o-chloroanilino)-6-diethylaminofluoran, dialkylamino-dialkylfluoran such as 3-dimethylamino-5-methyl-7-methylfluoran and 3-diethylamino-6-methyl-8-methylfluoran, and halogenated fluoran having a dialkylamino group such as 3-dibutylamino-6-methyl-7-bromofluoran and 3-diethylamino-7-chlorofluoran.

Examples of the phthalide-based leuco dye may include 6-(dimethylamino)-3,3-bis[p-(dimethylamino)phenyl] phthalide (crystal violet lactone), 3-[2,2-bis(1-ethyl-2-methyl-3-indolyl)vinyl]-3-(4-diethylaminophenyl)phthalide, 3-[1,1-bis(4-diethylaminophenyl)ethylene-2-yl]-6-dimethylaminophthalide, 3,3-bis(1-n-butyl-2-methylindole-3-yl)phthalide, and 3,3-bis(4-diethylamino-2-ethoxyphenyl)-4-azaphthalide.

As the developer, an electron acceptor such as an acidic substance may be used. The developer may be appropriately selected according to the type of the leuco dye. Furthermore, a known developer is used. Examples of the developer may include acidic inorganic matter (for example, bentonite, zeolite, and silica gel), carboxylic acid (for example, aliphatic mono-carboxylic acid such as stearic acid, polycarboxylic acid such as oxalic acid and maleic acid, aliphatic hydroxycarboxylic acid such as tartaric acid, citric acid, and succinic acid, and aromatic carboxylic acid such as benzoic acid), as well as a compound having a phenolic hydroxyl group. One of these developers may be used alone. Alternatively, two or more of these developers may be used in combination.

Examples of the compound having a phenolic hydroxyl group may include hydroxyarene (for example, 4-tert-butylphenol, 4-phenylphenol, and β-naphthol), hydroxyarene carboxylic acid (for example, salicylic acid, 3-tert-butylsalicylic acid, 2-hydroxy-6-naphthoic acid, 2-hydroxy-p-tolilic acid, and 4-hydroxyphthalic acid), hydroxyarene carboxylic acid ester (for example, 5-hydroxyphthalic acid dimethyl, methyl-4-hydroxybenzoate, and 4-hydroxybenzoic acid ethyl), hydroxyarene carboxylic acid amide such as salicylanilide, metal salts of hydroxyarene carboxylic acid (for example, zinc salicylate, 2-hydroxy-6-zinc naphthoate, and 3,5-di-tert-tin butyl salicylate), bisphenols (for example, hydroxy biphenyl such as 2,2'-dihydroxydiphenyl, 4,4'-isopropylidendiphenol, and 4,4'-isopropylidenbis(2-chlorophenol)), novolac-type phenolic resin, diarylsulfone having a phenolic hydroxyl group (for example, di(4-hydroxyphenyl) sulfone and 4,2'-dihydroxydiphenylsulfone), and diaryl sulfide having a phenolic hydroxyl group (for example, bis(4-hydroxyphenyl)sulfide)).

The color developing material such as the leuco dye and the developer is usually contained in a form of particles in the recording layer 2. When the color developing material has a large particle size, the particles give irregular reflection of light, thereby sometimes reducing transparency of the recording layer 2 and the portion formed on the front surface side to the printed layer 4 of the thermal recording sheet. Therefore, the color developing material preferably has a small particle size. The color developing material (such as the leuco dye and the developer) has an average particle size of, for example, 0.1 to 3 μm, preferably 0.1 to 1 μm, and further preferably 0.1 to 0.7 μm.

It is noted that as described herein, the average particle size refers to a 50% average particle size (median size) in a particle size distribution by volume standard measured using a Microtrac laser analysis and scattering particle size analyzer.

The color developing temperature of the color developing material differs depending on the type of the color developing material. The type of the color developing material may be appropriately selected such that it generates heat at a desired heat generation temperature, according to, for example, the temperature of a heating body such as a thermal head used in printing.

The amount of the color developing material in the recording layer 2 can be appropriately selected according to, for example, the absorbance in the visible light range in a state in which the color developing material develops color. This amount is, for example, 10 to 70% by mass, preferably 20 to 60% by mass, and further preferably 30 to 50% by mass. When the color developing material includes the leuco dye and the developer, the mass ratio of the developer to the leuco dye (=developer/dye) can be appropriately selected according to the types of the leuco dye and the developer. The mass ratio is, for example, 1/1 to 5/1, and preferably 1.5/1 to 3/1.

The recording layer 2 may include a binder for binding the color developing material. As the binder, resins and macromolecules (synthetic macromolecules and natural macromolecules) can be used. The binder is preferably a hydrophilic or water-soluble binder and a water-dispersible binder.

Examples of such a binder may include vinyl acetate resin or saponified products thereof (for example, homopolymers or copolymers of vinyl acetate such as polyvinyl acetate, vinyl acetate-maleic anhydride copolymers, and vinyl acetate-vinyl chloride copolymers, polyvinyl alcohol (PVA), and modified PVA (saponified products of vinyl acetate copolymers)), olefin resin (for example, copolymers between olefin and polymerizable unsaturated carboxylic acid or anhydrides thereof such as isopropylene-maleic anhydride copolymers, isobutylene-maleic anhydride copolymers, diisobutylene-maleic anhydride copolymers, and methyl vinyl-maleic anhydride copolymers), styrene resin (for example, polystyrene, and copolymers between styrene and polymerizable unsaturated carboxylic acid or anhydrides thereof such as styrene-maleic anhydride copolymers), polyamide resin (for example, polyamide, polyester amide, and polyamide imide), vinyl cyanide resin (for example, polyacrylonitrile, and acrylonitrile copolymers), acrylic resin (for example, poly(meth)acrylic acid, polyacrylic acid ester, copolymers between (meth)acrylic acid and (meth)acrylic acid ester such as acrylic acid-acrylic acid ester copolymers, and acrylamide resin such as polyacrylamide and modified polyacrylamide), alkyl vinyl ether resin (for example, polymethyl vinyl ether), vinyl chloride or vinylidene chloride resin (for example, polyvinyl chloride, polyvinylidene chloride, and copolymers containing vinyl chloride and/or vinylidene chloride as a monomeric unit), urethane resin (for example, polyether polyurethane and polyester polyurethane), polyvinylpyrollidone, rubber-like polymers (for example, styrene-butadiene rubber (SBR) and acryl rubber), rubber (for example, gum arabic), cellulose derivatives (for example, cellulose ethers such as methyl cellulose, carboxymethyl cellulose, hydroxyethyl cellulose, and hydroxypropyl cellulose), polysaccharides (for example, starch and modified starch), and protein (for example, casein, gelatin, and glue).

In the above-described binder, examples of the polymerizable unsaturated carboxylic acid or anhydrides thereof which are copolymerizable monomers may include carboxylic acid having an ethylene unsaturated bond or anhydrides thereof such as (meth)acrylic acid, maleic acid, fumaric acid, and maleic anhydrides. The use of the polymerizable unsaturated carboxylic acid or anhydrides thereof as copolymerizable monomers allows carboxyl groups or acid anhydride groups to be introduced into resin. This can impart hydrophilicity or water-solubility. It is noted that acrylic acid and methacrylic acid are collectively referred to as (meth)acrylic acid. Acrylic acid ester and methacrylic acid ester are collectively referred to as (meth)acrylic acid ester. Furthermore, introduction of amide groups or amino groups into acrylamide resin enables hydrophilicity and/or water-solubility to be imparted to the resin.

One of the above-described binders may be used alone. Alternatively, two or more of the above-described binders may be used in combination. Among these, the rubber-like polymers such as acrylic resin, saponified products of vinyl acetate resin (for example, PVA and modified PVA), and SBR are preferably used. The saponified products of vinyl acetate resin have high hydrophilicity or water-solubility. Therefore, they have high compatibility with the color developing material and the substrate layer 3, and high film formation properties. Therefore, transparency can be easily enhanced. Also, the use of the acrylic resin or the rubber-like polymers ensures high transparency, and furthermore, easily enhances binding properties.

The amount of the binder relative to 100 parts by mass of the color developing material is, for example, 10 to 70 parts by mass, preferably 20 to 65 parts by mass, and further preferably 35 to 60 parts by mass.

The recording layer 2 may further include a filler or a lubricant. Examples of the filler may include an inorganic filler and an organic filler (for example, styrene resin such as polystyrene (PS), olefin resin such as polyethylene (PE), acrylic resin such as polymethyl methacrylate (PMMA), and various resin particles such as urea resin). The resin particles may be hollow resin particles (or resin microcapsules). Examples of the inorganic filler may include a mineral-based filler (for example, active terra alba, kaolin such as kaolinite, calcined kaolin, talc, clay, and diatomaceous earth), silicon-containing compounds (for example, silicon oxides such as white carbon and silica gel, and silicate salts such as aluminum silicate), and metal compounds (for example, metal oxides such as magnesium oxide, aluminum oxide, titanium oxide, and zinc oxide, metal hydroxides such as magnesium hydroxide and aluminum hydroxide, and metal inorganic acid salts such as magnesium carbonate, calcium carbonate, and barium sulfate). One of these fillers may be used alone. Alternatively, two or more of these fillers may be used in combination.

The amount of the filler relative to 100 parts by mass of the color developing material is, for example, 5 to 40 parts by mass, and preferably 15 to 30 parts by mass.

Examples of the lubricant may include wax (for example, polyolefin wax such as paraffin wax, ester wax such as carnauba wax, and polyethylene wax), oils and fats (for example, higher fatty acid such as oleic acid, higher fatty acid salts (for example, metal soap such as zinc stearate), animal oil and fat such as whale oil, and vegetable oil and fat), and silicone oil. One of these lubricants may be used alone. Alternatively, two or more of these lubricants may be used in combination.

The amount of the lubricant relative to 100 parts by mass of the color developing material is, for example, 1 to 40 parts by mass, preferably 5 to 35 parts by mass, and further preferably 10 to 30 parts by mass.

When the binder, the filler, and the lubricant are contained in the recording layer 2 in a form of particles, the particle size of the particles is preferably small similarly to the color developing material, from the viewpoint of suppression of irregular reflection. These particles have an average particle size of, for example, 1 μm or less, preferably 0.5 μm or less, and further preferably 0.4 μm or less. The average particle size is preferably smaller. The lower limit of the average particle size is, for example, 0.01 μm or more.

Among the binder, the filler, and the lubricant, the material which melts at relatively low temperature melts in, for example, the step of forming the recording layer 2, the step of forming a later-described intermediate layer or the printed layer, or the step of allowing the color developing material to develop color. This material intrudes into a space between the particles contained in the recording layer 2 or into a space to be formed at an interface between the substrate layer 3 and the recording layer 2. This reduces unevenness between the particles and at the interface. This suppresses irregular reflection in the recording layer 2, and also in the thermal recording sheet 1. Accordingly, transparency can be improved. The component that forms the recording layer 2 and suppresses irregular reflection in this manner is referred to as a first irregular reflection suppression component. The component having other functions such as the binder, the filler and the lubricant as described above may function as the first irregular reflection suppression component. Alternatively, a component other than these components contained in the recording layer 2 may function as the first irregular reflection suppression component.

The first irregular reflection suppression component preferably has a low melting point that is lower than the temperature at which each layer including the recording layer 2 is formed, and the color developing temperature of the color developing material. Examples of the organic material that serves as the first irregular reflection suppression component may include resin that serves as the binder such as polyethylene, an organic filler, wax, and oils and fats. One of the first irregular reflection suppression components may be used alone. Alternatively, two or more of the first irregular reflection suppression components may be used in combination.

The first irregular reflection suppression component to be used is particularly preferably wax, and oils and fats, and especially paraffin (paraffin wax). The first irregular reflection suppression component has a melting point that is preferably lower than the color developing temperature of the color developing material. The use of such a first irregular reflection suppression component causes the first irregular reflection suppression component to melt at least when typing is performed in the thermal recording sheet. This can effectively suppress irregular reflection in the thermal recording sheet. Also, the first irregular reflection suppression component further preferably has a melting point that is lower than the temperature at which each layer including the recording layer 2 is formed. When the melting point is lower than the temperature at which these layers are formed, the first irregular reflection suppression component melts when each layer is formed. This can effectively suppress irregular reflection in the thermal recording sheet. Furthermore, high transparency can be obtained even before the color developing material develops color.

The first irregular reflection suppression component has a melting point of, for example, lower than 80° C., preferably 65° C. or lower, and further preferably 50° C. or lower. The lower limit of the melting point of the first irregular reflection suppression component is not particularly limited. The lower limit thereof is, for example, 35° C. or higher. When the melting point of the first irregular reflection suppression component falls within such a range, the first irregular reflection suppression component is likely to melt during the process of preparing the thermal recording sheet, during the process of manufacturing a packaging container from a packaging sheet, or during performing typing. Therefore, such a first irregular reflection suppression component is advantageous in terms of suppressing irregular reflection.

The first irregular reflection suppression component preferably has a form of particles before being melted in the recording layer 2. The first irregular reflection suppression component has an average particle size of, for example, 1 μm or less, preferably 0.05 to 0.5 μm, and further preferably 0.1 to 0.4 μm. When the average particle size falls within such a range, the first irregular reflection suppression component is easily dispersed in the recording layer 2. Therefore, when the first irregular reflection suppression component is melted, it can relatively uniformly melt. Irregular reflection can also be easily suppressed even when the first irregular reflection suppression component exists in a form of particles in the recording layer 2, without being melted.

The amount of the first irregular reflection suppression component relative to 100 parts by mass of the color developing material is, for example, 1 to 40 parts by mass, preferably 5 to 35 parts by mass, and further preferably 10 to 30 parts by mass. When the amount of the first irregular reflection suppression component falls within such a range, irregular reflection in the thermal recording sheet, particularly in the recording layer 2, or at an interface between the recording layer 2 and the substrate layer 3, can be more effectively suppressed without damaging the readability of typed contents.

The recording layer 2 is formed, for example, as below. That is, a coating liquid prepared by dispersing the above-described constituent materials in a dispersion medium is applied on the surface on the front surface side of the printed layer 4. Next, the obtained coat is dried.

When dispersing the constituent material of the recording layer 2 in the dispersion medium, a known pulverizer such as a sand mill and a bead mill, as well as a known mixer, may be used. As the dispersion medium, an organic solvent such as alcohol, ketone, and nitrile is used. Preferably, water is used.

The coat can be dried under atmospheric pressure or reduced pressure. The temperature of the layered body including the formed coat during drying may be controlled to be higher than the melting point of the first irregular reflection suppression component. This enables the first irregular reflection suppression component to be melted. Therefore, irregular reflection can be effectively suppressed. On the other hand, in order to prevent the recording layer 2 from thermally reacting, the temperature of the layered body including the formed coat needs to be controlled not to become excessively high. From such a viewpoint, the temperature may be appropriately selected from the range of, for example, 25 to 100° C. More specifically, the temperature is set to be preferably 50 to 100° C., and further preferably 80 to 100° C.

The mass of the recording layer 2 per unit area is, for example, 1 to 10 g/m$^2$, and preferably 2 to 6 g/m$^2$. When the mass of the recording layer 2 falls within such a range, the thickness of the recording layer 2 can be defined in an appropriate range. Therefore, typing properties and transparency are likely to be balanced.

It is noted that in the present embodiment, the recording layer 2 is formed on the whole surface on the front surface side of the printed layer 4. However, when typing is desired to be performed on a restricted area of the thermal recording sheet, the recording layer 2 may be formed only in such an area. This enables the thermal material to be saved.

(Protective Layer 5)

The protective layer 5 is disposed in order to protect the layer on the back surface side to the protective layer 5, such as the recording layer 2, from deterioration. Also, the protective layer 5 may have a function of increasing the contact properties between a heating body such as a thermal head and the thermal recording sheet during typing so that the recording layer 2 smoothly develops color. The protective layer 5 may be formed on the whole or part of the surface on the front surface side of the recording layer 2.

The protective layer 5 contains, for example, a binder, a filler, or the like. The inclusion of a filler can provide appropriate strength. The filler of the protective layer 5 preferably contains colloidal silica. Colloidal silica functions as a filler. Colloidal silica has a small particle size. Therefore, irregular reflection in the thermal recording sheet, particularly in the protective layer 5, is suppressed. This can enhance the transparency of the protective layer 5 and the thermal recording sheet.

Colloidal silica is colloid of silicon oxide or a hydrate thereof.

From the viewpoint of suppressing irregular reflection, colloidal silica has an average particle size of, for example, 500 nm or less, preferably 400 nm or less, and further preferably 300 nm or less. The average particle size of colloidal silica is, for example, 1 nm or more. The protective layer 5 can contain, as colloidal silica, a plurality of particle groups each having a different particle size distribution. For example, colloidal silica having an average particle size of not less than 1 nm and less than 20 nm and colloidal silica having an average particle size of, for example, 20 to 500 nm, and preferably 20 to 100 nm, may be used in combination. The use of such a combination of a small particle group and a large particle group increases the strength of the protective layer 5, and furthermore facilitates maintenance of high transparency.

The amount of colloidal silica in the protective layer 5 is, for example, 10 to 65% by mass, preferably 10 to 60% by mass, further preferably 10 to 50% by mass, and particularly 25 to 50% by mass. When the amount of colloidal silica falls within such a range, the strength of the protective layer 5 and the high transparency are easily balanced.

Examples of the binder in the protective layer 5 may include thermosetting resin such as acrylic resin (for example, poly(meth)acrylic acid), epoxy resin, and phenolic resin, as well as the above-described examples of the binder in the recording layer 2. As the thermosetting resin, self-crosslinkable thermosetting resin or a composition containing a base resin and a crosslinking agent may be used. An example of such a composition may include a composition containing an acrylic resin having a carboxyl group such as polyacrylic acid and a crosslinking agent of a carboxyl group. As the crosslinking agent, any known crosslinking agent such as ammonium zirconium carbonate can be used according to the type of the functional group possessed by the base resin. Also, as the thermosetting resin, a substance containing a curing agent, a curing accelerator, or the like may be used as necessary. One of the binders may be used alone. Alternatively, two or more of the binders may be used in combination.

The amount of the binder in the protective layer 5 is, for example, 10 to 70% by mass, preferably 20 to 60% by mass, and further preferably 25 to 50% by mass. Also, the amount of the binder relative to 100 parts by mass of colloidal silica in the protective layer 5 is, for example, 50 to 500 parts by mass, and preferably 80 to 200 parts by mass.

The protective layer 5 may further contain a filler and a lubricant other than colloidal silica. The filler and the lubricant can be appropriately selected from the examples described above concerning the recording layer 2. The filler is preferably an organic filler such as PS particles and PMMA particles, and metal compounds (for example, metal salts) such as calcium carbonate.

The average particle size of the filler can be appropriately selected from the examples described above concerning the recording layer 2. The lubricant has an average particle size of, for example, 0.01 to 7 μm, and preferably 0.05 to 6 μm.

The amount of each of the filler and the lubricant other than colloidal silica relative to 100 parts by mass of colloidal silica is, for example, 1 to 40 parts by mass, preferably 5 to 35 parts by mass, and further preferably 10 to 30 parts by mass. When the amount of each of the filler and the lubricant falls within such a range, the strength of the protective layer 5 is retained, and furthermore, transparency can be easily ensured.

The protective layer 5 is formed, for example, as below. That is, a coating liquid prepared by dispersing the constituent material of the protective layer 5 in a dispersion medium is applied on the surface on the front surface side of the intermediate body of the layered thermal recording sheet. Next, the obtained coat is dried. Examples of the dispersion medium to be used in the coating liquid may include the dispersion media described as examples concerning the recording layer 2. The drying condition is not particularly limited, as long as the dispersion medium in the coating liquid can be removed. This drying condition may be the same as the drying condition when forming the recording layer 2.

The mass of the protective layer 5 per unit area can be set to be, for example, 0.1 to 5 $g/m^2$, and preferably 0.5 to 2.5 $g/m^2$ in terms of dry mass. When the mass of the protective layer 5 falls within such a range, transparency and appropriate strength of the thermal recording sheet are easily ensured.

Second Embodiment

The configuration of the second embodiment is the same as the above-described thermal recording sheet 1 according to the first embodiment, except that the position of the printed layer is different. Therefore, only the difference is described in detail. Other descriptions will be omitted.

Figure 2:
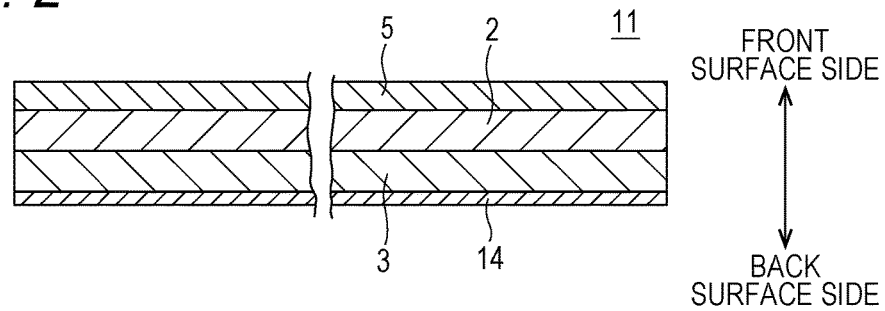
FIG. 2 is a schematic cross-sectional view of a thermal recording sheet according to a second embodiment.

FIG. 2 is a schematic cross-sectional view of a thermal recording sheet according to the second embodiment of the present invention. As apparent from FIG. 2, the printed layer is not formed between the substrate layer 3 and the recording layer 2. A printed layer 14 is formed on the back surface side of the substrate layer 3. Also, the printed layer 14 is formed on the whole surface on the back surface side of the substrate layer 3. In the present embodiment, the substrate layer 3 is formed with a transparent material such as a transparent resin film. Thus, the "portion formed on the front surface side to the printed layer" contains the substrate layer 3 in addition to the recording layer 2 and the protective layer 5.

In the present embodiment, the portion formed on the front surface side to the printed layer 14 is transparent in a state before the recording layer 2 develops color. Therefore, printed contents can be clearly recognized from the front surface side of the thermal recording sheet. Furthermore, color developing properties of the recording layer 2 is not damaged. Therefore, typed contents formed in the recording layer 2 by color development can be clearly recognized.

Third Embodiment

The third embodiment is the same as the above-described first embodiment, except for the shape aspect of the printed layer. Therefore, the different configuration will be described in detail, and descriptions of other configuration will be omitted.

Figure 3:
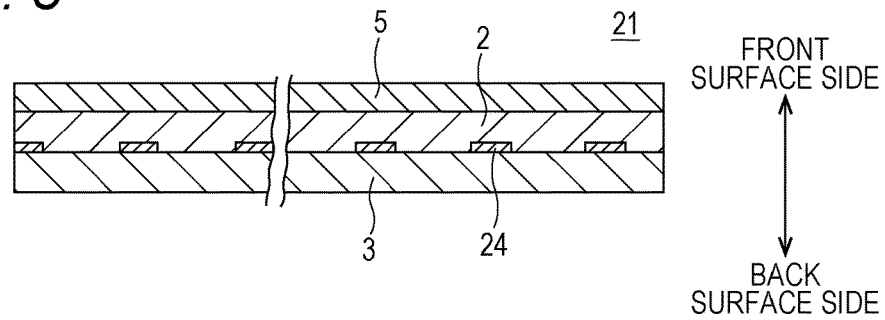
FIG. 3 is a schematic cross-sectional view of a thermal recording sheet according to a third embodiment.

FIG. 3 is a schematic cross-sectional view of a thermal recording sheet 21 according to the third embodiment of the present invention. In the thermal recording sheet 21, a printed layer 24 is formed in a restricted area of the surface on the back surface side of the recording layer 2, that is, the surface on the front surface side of the substrate layer 3. The configuration other than this is the same as the thermal recording sheet 1 of FIG. 1.

As illustrated in FIG. 3, in the present embodiment, the printed layer 24 is formed only on part of the surface on the back surface side of the substrate layer 3. According to this configuration, when the substrate layer 3 is formed with a transparent material, the area in which the printed layer 24 is not formed is transparent. Therefore, when an object is packaged with the thermal recording sheet 21, the object can be visually recognized through the sheet. Furthermore, a printing material such as ink may be possibly saved. Moreover, for example, when the typing color of the recording layer 2 is black, and the printing color of the printed layer 24 is deep color, contents typed in the area in which the printed layer 24 is formed possibly become difficult to be visually recognized. Even in such a case, the visual recognition properties of typed contents does not decrease under the influence of the printed layer 24 by forming the printed layer 24 in a restricted area as in the present embodiment, and by performing typing in the area in which the printed layer 24 is not formed.

Fourth Embodiment

The fourth embodiment is the same as the above-described second embodiment, except for the shape aspect of the printed layer. Therefore, the different configuration will be described in detail, and descriptions of other configuration will be omitted.

Figure 4:
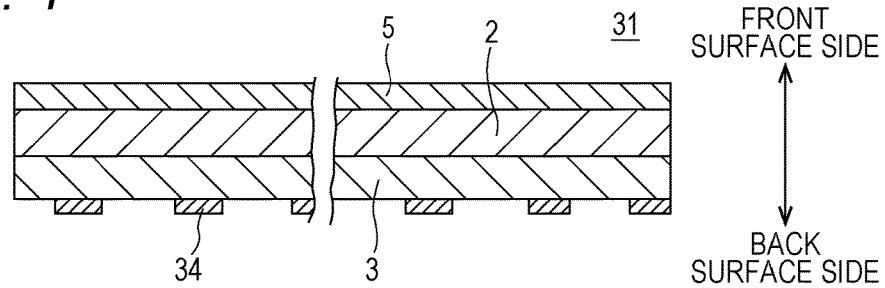
FIG. 4 is a schematic cross-sectional view of a thermal recording sheet according to a fourth embodiment.

FIG. 4 is a schematic cross-sectional view of a thermal recording sheet 31 according to the fourth embodiment of the present invention. In the thermal recording sheet 31, a printed layer 34 is formed in a restricted area of the surface on the back surface side of the substrate layer 3. The configuration other than this is the same as the thermal recording sheet 11 of FIG. 2. Even such a configuration can provide similar effects to the above-described third embodiment. The front or back side of the substrate layer 3 may be appropriately selected as the side on which the printed layer is formed, in view of the purposes and the easiness of manufacture.

Fifth Embodiment

The fifth embodiment is the same as the above-described third or fourth embodiment, except for the shape and position of the printed layer. Therefore, the different configuration will be described in detail, and descriptions of other configuration will be omitted.

Figure 5:
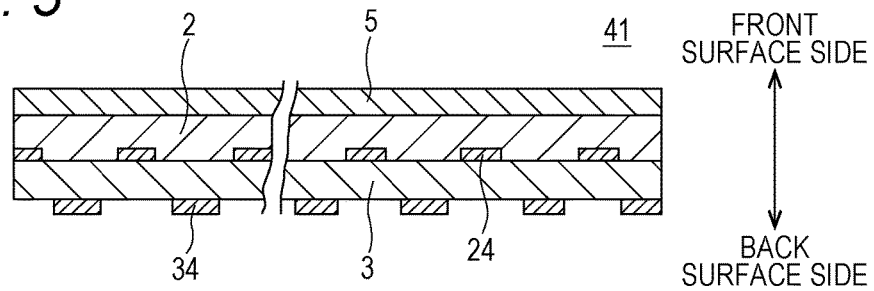
FIG. 5 is a schematic cross-sectional view of a thermal recording sheet according to a fifth embodiment.

FIG. 5 is a schematic cross-sectional view of a thermal recording sheet according to the fifth embodiment of the present invention. As illustrated in FIG. 5, in a thermal recording sheet 41, the printed layer 24 is formed in a restricted area on the front surface side of the substrate layer 3, similarly to the third embodiment. At the same time, the printed layer 34 is formed in a restricted area on the back surface side of the substrate layer 3, similarly to the fourth embodiment. For example, a different effect can be provided to a person who visually recognizes from the front surface side, by changing ink or a printing method when forming the printed layer 24 and the printed layer 34. This can improve design features. Furthermore, when printing is performed with pale color in one of the printed layers, and typing is performed in the area where the printed layer is formed with pale color, the visual recognition properties of typed contents can also be improved.

In the present embodiment, the area in which the printed layer 24 is formed and the area in which the printed layer 34 is formed are disposed in such a manner as not to overlap each other. However, for example, both may be disposed in such a manner to overlap each other, or at least one may be formed on the whole surface. The thermal sheet can also be configured such that the printed layers overlap each other to be partly concealed. Furthermore, at least one of the printed layers may be configured to be transparent, thereby providing the effect of mixed colors in part or the whole of the area. Moreover, printed contents may also be visually recognized in a different manner between when visually recognized from the back surface side and when visually recognized from the front surface side.

Sixth Embodiment

The sixth embodiment is the same as the above-described first embodiment, except that the intermediate layer is formed. Therefore, the different configuration will be described in detail, and descriptions of other configuration will be omitted.

Figure 6:
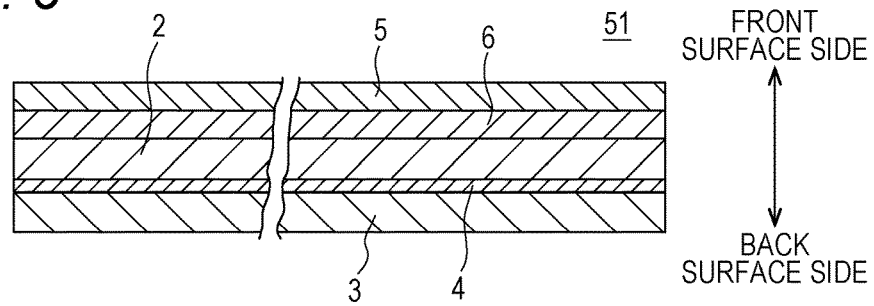
FIG. 6 is a schematic cross-sectional view of a thermal recording sheet according to a sixth embodiment.

FIG. 6 is a schematic cross-sectional view of a thermal recording sheet according to the sixth embodiment of the present invention. In a thermal recording sheet 51, an intermediate layer 6 is formed between the recording layer 2 and the protective layer 5. In this configuration, the portion formed on the front surface side to the printed layer 4 contains the intermediate layer 6, in addition to the recording layer 2 and the protective layer 5. The intermediate layer 6 will be described.

(Intermediate Layer 6)

The intermediate layer 6 is disposed in order to enhance barrier properties of the thermal recording sheet. Specifically, when the intermediate layer 6 is a layer containing hydrophilic resin, water-soluble resin, or water-dispersible resin, intrusion of oily ingredients from the front surface side can be suppressed. Therefore, the disposition of the intermediate layer 6 improves oil resistance. On the other hand, when the intermediate layer 6 is a layer containing resin of hydrophobic resin or the like, intrusion of aqueous ingredients from the front surface side can be suppressed. Therefore, the disposition of the intermediate layer 6 improves water resistance.

Examples of hydrophilic resin, water-soluble resin, or water-dispersible resin may include resins described as examples of the binder in the recording layer. Examples of hydrophobic resin may include acrylic resin, saponified products of vinyl acetate resin (for example, PVA and modified PVA), and rubber-like polymers such as SBR.

When the recording layer 2 is formed with a material containing a hydrophilic material, and the intermediate layer 6 containing hydrophilic resin or the like is formed, the hydrophilic resin in the intermediate layer 6 partly intrudes into the recording layer 2. Therefore, the interface between the intermediate layer 6 and the recording layer 2 is likely to become smooth. Accordingly, irregular reflection of light at the interface is suppressed. Also, the lipophilic resin or the like is embedded in spaces between the particles that form the recording layer. Therefore, irregular reflection inside the recording layer 2 is also suppressed. Furthermore, transparency of the recording layer 2 improves. As a result, transparency of the thermal recording sheet can be further enhanced. In this case, the hydrophilic resin or the like contained in the intermediate layer 6 functions as a second irregular reflection suppression component for suppressing irregular reflection in the thermal recording sheet. Examples of such hydrophilic resin or water-soluble resin may include acrylic resin (particularly, for example, acrylic resin to which a hydrophilic group such as a carboxyl group, an acid anhydride group, an amino group, and an amide group is introduced), other than saponified products of vinyl acetate resin such as PVA. Saponified products of vinyl acetate resin, particularly saponified products having a high saponification level such as PVA, contain many hydroxyl groups. Therefore, such resin has high hydrophilicity and water-solubility.

For forming the intermediate layer 6 containing hydrophilic resin or the like, the intermediate layer 6 may include a core shell-type particle in which the above-described hydrophilic resin or water-soluble resin is contained in a shell. In this case, the core material of the core shell-type particle is not particularly limited. Such a core material may be appropriately selected from the above-described examples of hydrophilic resin or water-soluble resin and the like. However, resin to be selected preferably contains hydrophobic resin such as crosslinked resin. The inclusion of hydrophobic resin in a core allows the core to remain in the intermediate layer 6 even after the hydrophilic resin or water-soluble resin contained in a shell have intruded into the recording layer from the intermediate layer 6. This can improve water resistance. Furthermore, irregular reflection in the recording layer and the intermediate layer 6 as well as at the interface between both is suppressed by the hydrophilic resin or water-soluble resin that have intruded into the recording layer from the intermediate layer 6. An example of the core shell-type particle may include a known core shell-type particle containing acrylic-based resin such as acrylamide resin (trade name "Barrier Star" (manufactured by Mitsui Chemicals, Inc.)).

The intermediate layer 6 is preferably formed on the front surface side of the recording layer in such a manner as to be at least partially in contact with the recording layer. The intermediate layer 6 can be formed on the whole or part of the surface on the front surface side of the recording layer. When the recording layer is formed in part of the area of the substrate layer 3, the intermediate layer 6 may be formed in such a manner as to cover the surface on the front surface side of the recording layer. Alternatively, the intermediate layer 6 may be formed in such a manner as to be in contact with both the surface on the front surface side of the recording layer and the surface on the front surface side of the substrate layer 3.

The intermediate layer 6 can be formed by drying a coat obtained by applying a coating liquid containing resin to the surface on the front surface side of the recording layer. The coating liquid has a form of, for example, a dispersion liquid or an emulsion. Examples of the dispersion medium to be used in the coating liquid may include the dispersion media having been described as examples concerning the recording layer. The coating liquid may contain a surfactant and the like as necessary. When resin contains water-soluble resin or hydrophilic resin, the water-soluble resin or hydrophilic resin can intrude into the recording layer during the drying of the coat. The drying condition is not particularly limited, as long as the dispersion medium in the coating liquid can be removed. This drying condition may be the same as the drying condition when forming the recording layer.

The mass of the intermediate layer 6 per unit area can be set to be, for example, 0.1 to 5 $g/m^2$, and preferably 0.5 to 3 $g/m^2$ in terms of dry mass. When the mass of the intermediate layer 6 falls within such a range, transparency is ensured, and furthermore, barrier properties can be easily ensured.

Seventh Embodiment

The seventh embodiment is the same as the above-described second embodiment, except that the intermediate layer is formed.

Figure 7:
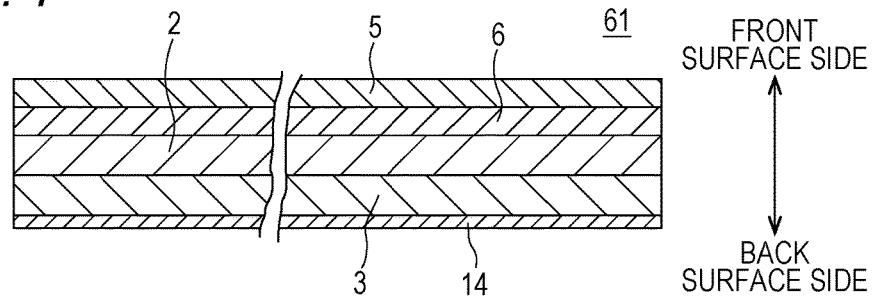
FIG. 7 is a schematic cross-sectional view of a thermal recording sheet according to a seventh embodiment.

FIG. 7 is a schematic cross-sectional view of a thermal recording sheet according to the sixth embodiment of the present invention. In a thermal recording sheet 61, the intermediate layer 6 is formed between the recording layer 2 and the protective layer 5. In this configuration, the portion formed on the front surface side to the printed layer 4 also contains the intermediate layer 6, in addition to the recording layer 2 and the protective layer 5, similarly to the sixth embodiment.

Eighth Embodiment

The eighth embodiment is the same as the above-described third embodiment, except that the intermediate layer is formed.

Figure 8:
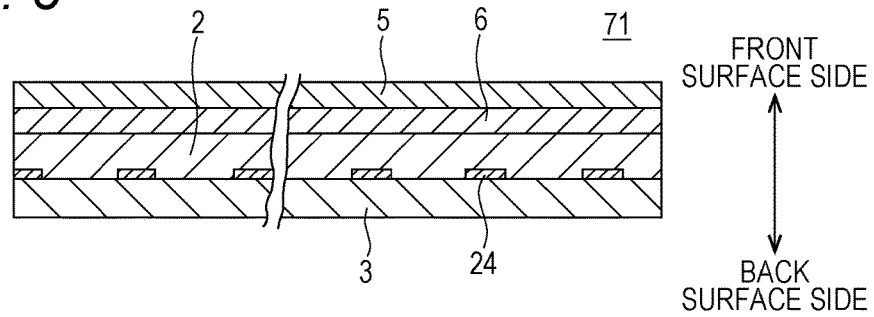
FIG. 8 is a schematic cross-sectional view of a thermal recording sheet according to an eighth embodiment.

FIG. 8 is a schematic cross-sectional view of a thermal recording sheet according to the eighth embodiment of the present invention. In a thermal recording sheet 71, the intermediate layer 6 is formed between the recording layer 2 and the protective layer 5. In this configuration, the portion formed on the front surface side to the printed layer 4 also contains the intermediate layer 6, in addition to the recording layer 2 and the protective layer 5, similarly to the sixth to seventh embodiments.

Ninth Embodiment

The ninth embodiment is the same as the above-described fourth embodiment, except that the intermediate layer is formed.

Figure 9:
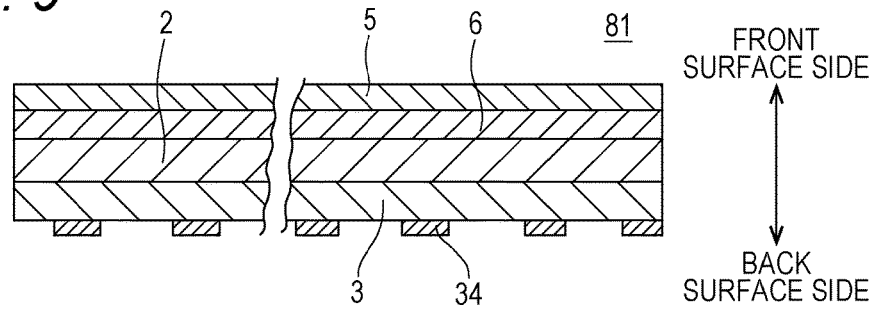
FIG. 9 is a schematic cross-sectional view of a thermal recording sheet according to a ninth embodiment.

FIG. 9 is a schematic cross-sectional view of a thermal recording sheet according to the ninth embodiment of the present invention. In a thermal recording sheet 81, the intermediate layer 6 is formed between the recording layer 2 and the protective layer 5. In this configuration, the portion formed on the front surface side to the printed layer 4 also contains the intermediate layer 6, in addition to the recording layer 2 and the protective layer 5, similarly to the sixth to eighth embodiments.

Tenth Embodiment

The tenth embodiment is the same as the above-described fifth embodiment, except that the intermediate layer is formed.

Figure 10:
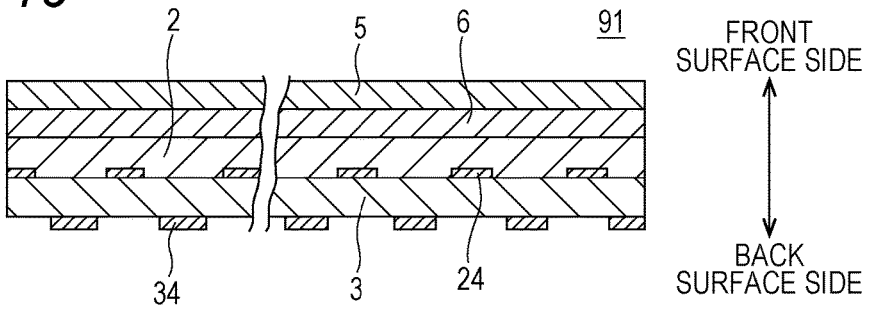
FIG. 10 is a schematic cross-sectional view of a thermal recording sheet according to a tenth embodiment.

FIG. 10 is a schematic cross-sectional view of a thermal recording sheet according to the tenth embodiment of the present invention. In a thermal recording sheet 91, the intermediate layer 6 is formed between the recording layer 2 and the protective layer 5. In this configuration, the portion formed on the front surface side to the printed layer 4 also contains the intermediate layer 6, in addition to the recording layer 2 and the protective layer 5, similarly to the sixth to ninth embodiments.

Tenth Embodiment

The tenth embodiment is the same as the above-described fifth embodiment, except that the intermediate layer is formed.

FIG. 10 is a schematic cross-sectional view of a thermal recording sheet according to the tenth embodiment of the present invention. In a thermal recording sheet 91, the intermediate layer 6 is formed between the recording layer 2 and the protective layer 5. In this configuration, the portion formed on the front surface side to the printed layer 4 also contains the intermediate layer 6, in addition to the recording layer 2 and the protective layer 5, similarly to the sixth to ninth embodiments.

Eleventh Embodiment

The present embodiment is an embodiment having an undercoat layer. Other configuration is the same as the ninth embodiment. Therefore, the undercoat layer will be described in detail. Descriptions of other configuration will be omitted.

Figure 11:
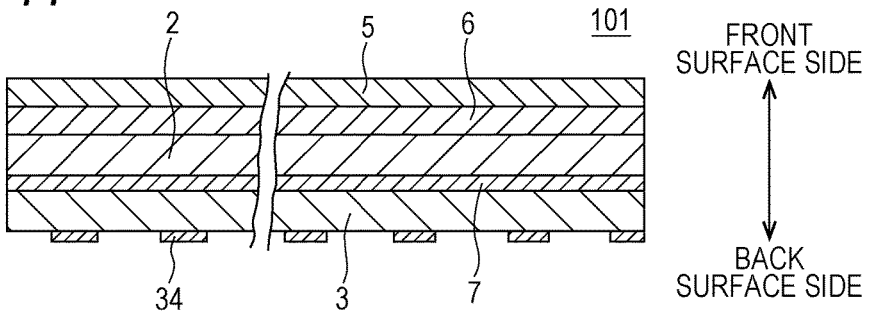
FIG. 11 is a schematic cross-sectional view of a thermal recording sheet according to an eleventh embodiment.

FIG. 11 is a schematic cross-sectional view of a thermal recording sheet according to the eleventh embodiment of the present invention. In a thermal recording sheet 101, an undercoat layer 7 is formed between the recording layer 2 and the substrate layer 3. In this configuration, the portion formed on the front surface side to the printed layer 4 contains the intermediate layer 6 and the undercoat layer 7, in addition to the recording layer 2 and the protective layer 5. Hereinafter, the undercoat layer 7 will be described.

(Undercoat Layer 7)

The undercoat layer 7 contains, for example, a binder and a filler. Examples of the binder and the filler to be used in the undercoat layer 7 may respectively include the binders and the fillers having been described as examples for the recording layer. The disposition of such an undercoat layer 7 can enhance adhesion between the recording layer 2 and the substrate layer 3.

Furthermore, the undercoat layer 7 may be formed on the whole or part of the surface between the recording layer 2 and the substrate layer 3.

The above-described first to eleventh embodiments may be modified to be implemented as below.

In each of the above-described embodiments, a heat seal layer may be further formed on the outermost back surface side of the thermal recording sheet. The disposition of the heat seal layer enables easier formation of a packaging container by thermal welding. Furthermore, the thermal recording sheet can be used as a wrapper or the like.

Also, in place of the heat seal layer according to the above-described variation, an adhesive layer including an adhesive agent as a main material may be formed. The disposition of the adhesive layer enables easy pasting to an adherend. According to such a configuration, the thermal recording sheet can be used as a sticker, a label, or an adhesive tape.

The thermal recording sheet may include a release layer having release properties to the adhesive layer on the outermost front surface side. According to such a configuration, even in the case of the above-described configuration including the adhesive layer, the thermal recording sheet can be superimposed to each other without being fixed to each other. Thus, the thermal recording sheet in a long form or in a tape form can be rolled to be supplied. Furthermore, when the thermal recording sheet is in a form of pieces, the pieces can be superimposed to each other to be supplied.

Furthermore, in the case of the above-described configuration including the adhesive layer, a particular release paper sheet may be further provided on the back surface side. Such a configuration enables the thermal recording sheet to be supplied in a state of being temporarily adhered to a release paper sheet.

In each of the above-described embodiments, the thermal recording sheet may certainly include any known layer used in a thermal recording sheet other than the above layers as necessary, other than the above-described layers, within the range that does not impair the effects of the present invention.

Each of the first to eleventh embodiments is merely illustrative about the layer configuration of the thermal recording sheet. The location of each layer is not limited to the above-described embodiments.

EXAMPLES

Hereinafter, the present invention will be specifically described based on examples and comparative examples. However, the present invention is not limited to the following examples.

Example 1

(1) Formation of Recording Layer

A coating liquid (coating liquid A) for the recording layer was prepared by dispersing, in an appropriate amount of water, 12 parts by mass of 2-anilino-6-di(n-butyl)amino-3-methylfluoran (average particle size: 0.5 μm) as a leuco dye, 25 parts by mass of 3,3'-diallyl-4,4'-dihydroxydiphenylsulfone (average particle size: 0.4 μm) as a developer, 20 parts by mass of SBR (styrene butadiene rubber, Tg −3° C.) as a binder, 10 parts by mass of kaolin (average particle size: 0.4 μm) as a filler, and 4 parts by mass of paraffin (melting point: 46° C., average particle size: 0.2 μm) as the first irregular reflection suppression component.

The coating liquid A was applied on the whole surface on the front surface side of an OPP film (biaxially stretched polypropylene film, thickness: 40 μm) as the substrate layer. The applied coating liquid A was dried to form the recording layer. At this time, the coating liquid A was applied in an amount of 4.0 g/m$^2$ in terms of the mass after drying.

(2) Formation of Intermediate Layer 6

A coating liquid (coating liquid B) for the intermediate layer was prepared by dispersing, in an appropriate amount of water, a core shell-type acrylic resin as the first irregular reflection suppression component. The coating liquid B was applied on the whole surface on the front surface side of the recording layer of the layered body obtained in the above-described (1). The applied coating liquid B was dried to form the intermediate layer. At this time, the coating liquid B was applied in an amount of 1.8 g/m$^2$ in terms of the mass after drying.

(3) Formation of Protective Layer

A coating liquid (coating liquid C) for the protective layer was prepared by dispersing, in an appropriate amount of water, 15 parts by mass of colloidal silica having a particle size of several nm, 30 parts by mass of colloidal silica having a particle size of several tens nm, 10 parts by mass of PE particles (average particle size: 0.12 μm), 5 parts by mass of zinc stearate (average particle size: 5.5 μm), 50 parts by mass of a binder (acrylic resin (polyacrylic acid), and 5 parts by mass of ammonium zirconium carbonate as a crosslinking agent.

The coating liquid C was applied on the whole surface on the front surface side of the intermediate layer of the layered body obtained in the above-described (2). The applied coating liquid C was dried to form the protective layer. At this time, the coating liquid C was applied in an amount of 1.5 g/m$^2$ in terms of the mass after drying.

The obtained layered body was measured for opacity in accordance with JIS P8138 using a reflectometer (manufactured by Tokyo Denshoku.co., Ltd., TC-6DS/A type reflectometer). As a result, the opacity was 7.4%.

(4) Formation of Printed Layer

The printed layer was formed on the whole surface on the back surface side of the substrate layer of the layered body obtained in the above-described (3) by gravure printing with ink containing aluminum powder. Thus, the thermal recording sheet was obtained.

(5) Thermal Typing

Typing was performed by allowing the recording layer of the thermal recording sheet obtained in the above-described (4) to partially develop color by heating with a thermal head. At this time, typing was performed so that the thermal head is brought into contact with the protective layer of the thermal recording sheet. According to visual observation of the obtained printed contents from the protective layer side, both the typed contents formed in the recording layer by color development and the printed layer could be clearly recognized.

INDUSTRIAL APPLICABILITY

According to the thermal recording sheet of the present invention, information can be recorded (typed) in the recording layer by a simple method such as thermal typing. Furthermore, both the information in the recording layer and the printed layer positioned on the back surface side to the recording layer can be clearly recognized from the front surface side of the sheet. Therefore, the thermal recording layer according to the present invention can be utilized in various applications in which thermal recording is used, such as a recording medium and a POS system. The thermal recording sheet is also effective when forming the printed layer containing metal. The thermal recording sheet containing a deposition film made of metal as the printed layer can also be utilized as a metal deposition film or the like. Furthermore, the thermal recording sheet can be utilized as a label, a sticker, a tape, or the like.

LIST OF REFERENCE NUMERALS

1, 11, 21, 31, 41, 51, 61, 71, 81, 91, 101 . . . Thermal recording sheet
2 . . . Recording layer
3 . . . Substrate layer
4, 14, 24, 34 . . . Printed layer
5 . . . Protective layer
6 . . . Intermediate layer
7 . . . Undercoat layer

The invention claimed is:

1. A thermal recording sheet having a front surface and a back surface opposite the front surface, comprising:
- a substrate layer;
- a recording layer formed on the front surface side of the substrate layer and containing a color developing material that develops color by heating;
- a protective layer formed on the further front surface side of the recording layer; and
- a printed layer formed on the back surface side of the substrate layer, wherein
- in a state before the recording layer develops color, the substrate layer, the recording layer and the protective layer are transparent.

2. The thermal recording sheet according to claim 1 wherein the printed layer contains metal.

3. The thermal recording sheet according to claim 1, wherein the substrate layer, the recording layer and the protective layer have an opacity of 25% or less in accordance with JIS P8138 in a state before the recording layer develops color.

4. The thermal recording sheet according to claim 1, wherein the recording layer contains a first irregular reflection suppression component, and the first irregular reflection suppression component contains an organic material having a melting point lower than a color developing temperature of the color developing material.

5. The thermal recording sheet according to claim 4, wherein the organic material contains paraffin.

6. The thermal recording sheet according to claim 1, further comprising an intermediate layer on the front surface side of the recording layer and on the back surface side of the protective layer, the intermediate layer being at least partially in contact with the recording layer, wherein the intermediate layer contains a second irregular reflection suppression component, and the second irregular reflection suppression component contains hydrophilic resin or water-soluble resin.

7. The thermal recording sheet according to claim 6, wherein the second irregular reflection suppression component is a core shell-type particle containing the hydrophilic resin or the water-soluble resin in a shell.

8. The thermal recording sheet according to claim 1, wherein the protective layer contains a binder and a filler, and the filler contains colloidal silica.

* * * * *